US005616104A

United States Patent [19]

Mulenburg et al.

[11] Patent Number: 5,616,104

[45] Date of Patent: Apr. 1, 1997

[54] HUMAN POWERED CENTRIFUGE

[75] Inventors: Gerald M. Mulenburg, Mountain View, Calif.; Joan Vernikos, Alexandria, Va.

[73] Assignee: The United States of America as Represented by the Administrator of the National Aeronautics and Space Administration, Washington, D.C.

[21] Appl. No.: 513,263

[22] Filed: Aug. 10, 1995

[51] Int. Cl.[6] ..... A63B 69/00

[52] U.S. Cl. ..... 482/57; 472/21; 472/35

[58] Field of Search ..... 482/51, 57, 148, 482/110; 472/1, 14, 16, 28, 17, 18, 21, 35, 36

[56] References Cited

U.S. PATENT DOCUMENTS

| | | | |
|---|---|---|---|
| 629,746 | 7/1899 | Grosset | 482/57 |
| 1,174,544 | 3/1916 | Bursteen | 482/57 |
| 1,409,071 | 3/1922 | Chakiris | 472/28 |
| 1,887,410 | 11/1932 | Holt . | |
| 2,497,372 | 2/1950 | Pricer . | |
| 3,083,037 | 3/1963 | Gordon et al. . | |
| 3,209,468 | 10/1965 | Frisch . | |
| 3,216,423 | 11/1965 | Blonsky et al. . | |
| 3,467,373 | 9/1969 | Justice . | |
| 3,602,501 | 8/1971 | Garner . | |
| 3,663,016 | 5/1972 | Morris . | |
| 3,675,259 | 7/1972 | Gilchrist . | |
| 3,677,541 | 7/1972 | Race . | |
| 3,826,488 | 7/1974 | Hall, Jr. . | |
| 3,936,047 | 2/1976 | Brandt et al. . | |
| 4,147,343 | 4/1979 | Hyde et al. . | |
| 4,428,576 | 1/1984 | Fisher, Jr. . | |
| 4,620,700 | 11/1986 | Snarr . | |
| 5,050,865 | 9/1991 | Augspurger et al. . | |
| 5,378,214 | 1/1995 | Kreitenberg . | |
| 5,395,290 | 3/1995 | Knijpstra . | |

*Primary Examiner*—Stephen R. Crow
*Attorney, Agent, or Firm*—Kenneth L. Warsh; Harry Lupuloff; John G. Mannix

[57] ABSTRACT

A human powered centrifuge has independently established turntable angular velocity and human power input. A control system allows excess input power to be stored as electric energy in a battery or dissipated as heat through a resistor. In a mechanical embodiment, the excess power is dissipated in a friction brake.

15 Claims, 3 Drawing Sheets

HUMAN POWERED CENTRIFUGE

ORIGIN OF THE INVENTION

The invention described herein was made in the performance of work under a NASA contract and is subject to Public Law 96-517 (35 U.S.C. 200 et seq.).

FIELD OF THE INVENTION

The present invention relates generally to exercise devices, and more specifically, to a human powered centrifuge. A platform supporting at least one rider is rotated by human power to achieve a predetermined angular velocity suitable for a desired G-force.

BACKGROUND OF THE INVENTION

An important requirement for long term human space flight is to provide the means necessary to maintain the health and physiological well being of the astronauts to ensure their ability to function both in weightlessness/microgravity and during and after landing.

Since the beginning of human space flight, adjusting to weightlessness/microgravity and readjusting to gravity has been of great concern for both the health and safety of the astronauts. Orthostatic intolerance, or fainting, is a serious concern during return to earth gravity after even short periods of weightlessness, especially for the flight crew responsible for piloting and landing the vehicle.

Among other problems of weightlessness, especially on long flights, are the loss of muscle tissue and bone strength which reduce the astronauts ability to perform essential tasks in a gravity environment.

These problems become compounded the longer the period of weightlessness. Providing simulated gravity using centrifugation has long been of interest as a countermeasure to these effects but remains unresolved to date partly due to the lack of adequate means to properly evaluate its efficacy both in space and on the ground.

In an analogous situation, long term bedrest due to injury or illness or even longterm inactivity such as with aging, can result in physiological changes similar to those found in astronauts during periods of weightlessness/microgravity. As a result, one of the frequently used ground models for studying these effects has been bedrest, especially when a 6° headdown tilt is used.

The use of passive (standing) methods of increasing the gravity stimulus on earth, has been shown to reduce orthostatic intolerance when used during bedrest. Active (treadmill exercise) exposure to G force during the same period of bedrest prevents other debilitating effects including calcium loss (which leads to bone strength loss), when compared with non G force exposure (continuous bedrest with no standing or exercise) for the same subjects, periods of time, and other conditions.

Human powered centrifuges have been in existence at least since the late 1700's. The use of these early devices varied from therapeutic to punishment. Later versions were designed primarily for entertainment or curiosity.

U.S. Pat. No. 5,378,214 to Kreitenberg discloses a self-powered human centrifuge which is described to be capable of simulating gravity and providing an aerobic workout as a countermeasure to the adverse physiological effects of prolonged spaceflight. The device includes bicycle-type chains and gearing disposed to rotate a frame in response to human peddling.

U.S. Pat. No. 1,887,410 to Holt describes an amusement device which includes a platform rotated by rider peddling.

While human powered centrifuge devices are generally known, the prior art does not provide a controllable platform in which a specific G force can be maintained constant while power input varies. Furthermore, no device can provide both "passive" increased G exposure (no exercise) or "active" (with exercise) increased G exposure.

SUMMARY OF THE INVENTION

An object of the present invention is to provide a centrifugal method and apparatus whereby persons experiencing long term bedrest from illness could be gradually exposed to increasing levels of G force to enhance their rehabilitation, and the benefits of gradually increasing exercise from powering a centrifuge.

Another object of the present invention is to provide a centrifugal method and apparatus whereby persons in bedrest recovering from injury to the lower extremities including hip and knee replacement surgery, for example, or fractures could benefit first from the G forces created by its rotation, and secondly by powering of the centrifuge (pedaling, stairstep, etc.) when they are able to do so.

Still another object of the invention is to provide a human centrifuge powered electrically, or which provides the capability for one, two, or more riders to rotate the centrifuge (one or more person powering it, with others riding passively or, just one rider plus a counter weight) by means of pedals or other foot and leg operated devices such as stepping or leg pushing, by arm motions or combinations of the two (i.e., rowing motion).

Another object of the present invention is to provide a human centrifuge powered by one or more persons riding on the centrifuge which has the capability to provide variable centrifugal force with constant rider power input, or a constant centrifugal force with variable rider power input.

These and other objects are met by providing an apparatus which includes a platform rotatable about an axis at an angular velocity sufficient to establish a G force, an electric AC or a human powered drive mechanism for imparting rotation to the platform, and control means for independently coupling the drive mechanism to the platform.

Other objects, advantages and salient features of the invention will become apparent from the following detailed description, which taken in conjunction with the annexed drawings, discloses preferred embodiments of the invention.

DETAILED DESCRIPTION OF THE INVENTION

Figure 1:
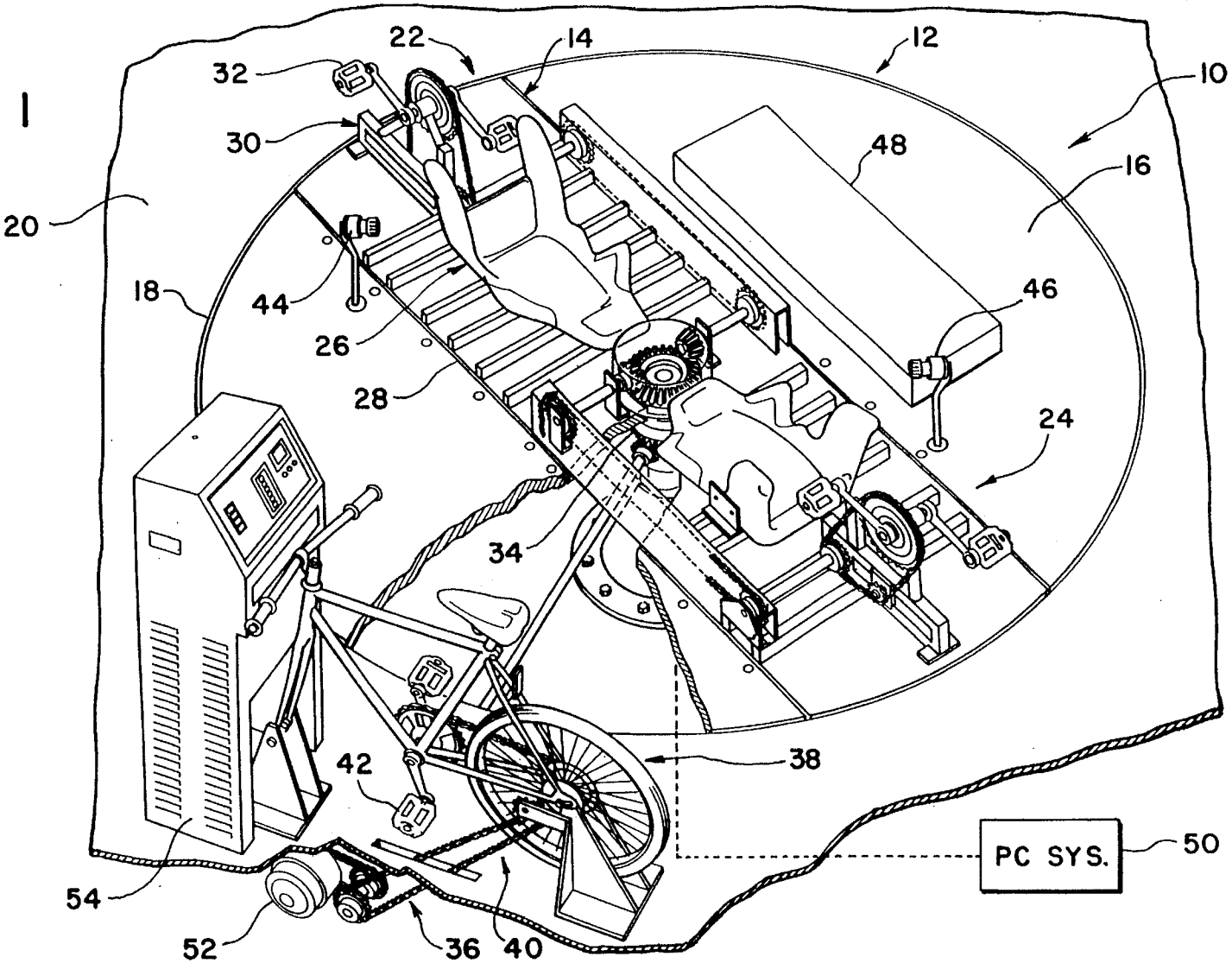
FIG. 1 is a perspective view, partially cut-away, of a human powered centrifuge according to a preferred embodiment of the present invention.

Referring to FIG. 1, a human powered centrifuge 10 includes a rotatable platform or turntable 12 which rotates about an axis normal to the plane of the turntable 12. The turntable 12 includes a center section 14 and two wing sections 16 and 18. The center and wing sections are preferably made of a light weight, yet strong honeycomb structure.

The wing sections 16 and 18 can be separately attached to the center section to provide a floor surface to walk on when a circular turntable shape is used. Although they are not necessary, they do provide capability to add additional riders if desired. When a turntable of circular shape is disposed coplanar within an opening provided in a stationary floor 20, a continuous surface is formed.

The turntable 12 carries two rider stations 22 and 24. Station 22 includes a recumbent rider seat 26 mounted by brackets (not shown) on plural parallel slats 28, and a pedal mechanism 30 mounted adjacent the rider seat 26. The pedal mechanism is a bicycle-type which includes pedals 32 mounted on opposed pedal cranks.

When rotated by human power, the pedals 32 impart rotation to a central hub 34 through a drive train that includes sprockets and chain driving a pinion meshing with a bevelled crown gear for a 4:1 reduction, for example.

Rider station 24 has components similar to those of the diametrically disposed rider station 22, and is independently coupled to the hub 34 so that a rider at either station, or both, could power the centrifuge 10.

An off-platform rider station 36 includes a stationary bike 38 which includes a pedal mechanism 40. The pedal mechanism includes pedals 42 mounted on opposed pedal cranks. When rotated by human power, these pedals 42 impart rotation to the central hub 34 through a drive train that includes sprockets and chain driving a pinion meshing with another bevelled crown mounted on the hub 34. A ratchet-type clutch associated with one of the sprockets permits free-wheeling should the stationary bicycle rider not wish to pedal.

With the basic mechanical apparatus described above, one or more riders can participate actively or passively in the operation of the centrifuge. If a platform rider wishes not to pedal, the drive train for each pedal mechanism includes at least one ratchet-type clutch which prevents the pedal cranks from rotating unless rotated by the rider, as in the free-wheeling action of a bicycle.

Optional equipment includes subject video monitoring equipment 44 and 46, and physiological monitoring equipment and/or infrared data transmission equipment, shown schematically by the numeral 48. Data from the monitoring equipment can be transmitted through slip ring wires to a personal computer (PC) system 50 located remote from the centrifuge in a control room, for example. An electronically actuated brake 52 is disposed in the drive train to provide a selectable and controlled torque for the rider at the station 36, which can be set and monitored at an off-platform monitoring station 54.

Figure 2:
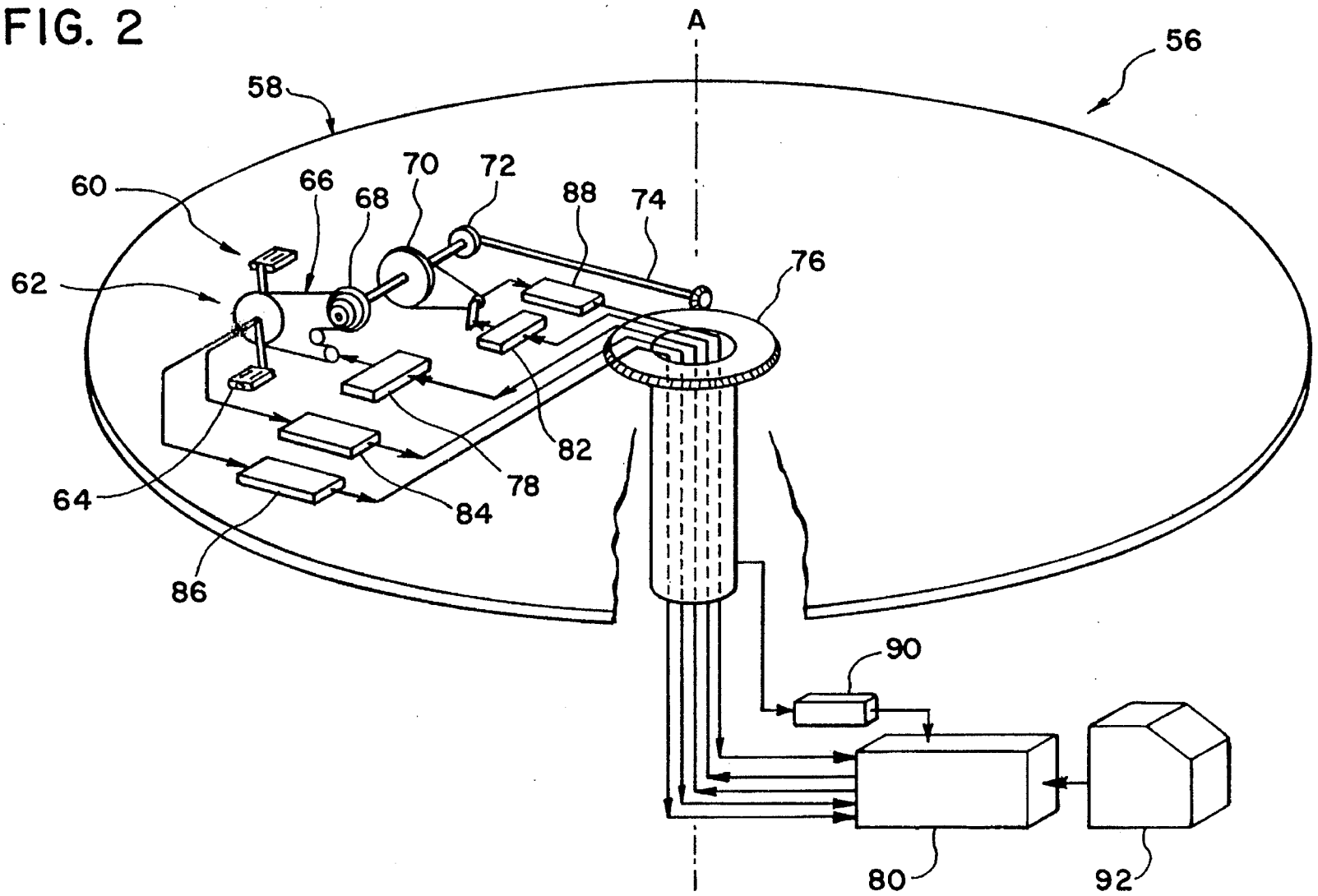
FIG. 2 is a schematic view of a human powered centrifuge according to the present invention.

Referring to FIG. 2, a human powered centrifuge 56, similar in concept to the embodiment of FIG. 1, includes a platform or turntable 58 mounted for rotation about a vertical axis "A." A single rider station 60 is shown on the turntable 58, but it is understood that plural stations could be provided both on the turntable or adjacent thereto on a stationary floor.

The rider station 60 includes a recumbent seat (not shown) and a pedal mechanism 62 which includes pedals 64 mounted on opposed pedal cranks. Initial chain power from the rider is transmitted through the bicycle-type pedal cranks. The chain 66 coming from the pedal crank drives an automatic transmission 68 that is composed of a freewheel that has sprockets (gears) of different radii of the same type used for bicycles or continuously variable transmission. The freewheel in the transmission protects the rider from the kinetic energy of the flywheel/centrifuge when the rider is not pedaling.

The automatic transmission 68 adjusts the gear ratio between the rider and the turntable 56 and maintains constant rider power demand. The power output from the automatic transmission 68 is sent through a flywheel friction brake 70 and through a slide collar 72 to the output shaft 74 that is connected to the hub 76 of the turntable 58. The slide collar 72 allows the rider to exercise when the centrifuge is stopped by disengaging the output shaft 74 which normally imparts rotary motion to the turntable 58. The flywheel friction brake 70 is adjustable to absorb extra energy supplied by the rider and not needed by the centrifuge. The flywheel also provides smooth pedaling especially when the centrifuge is disconnected at 0 turntable RPM.

A linear actuator 78 changes gears in the automatic transmission 68 in response to a command signal issued from a controller 80. Similarly, a linear actuator 82 adjusts the tension on the strap of the flywheel 70 in response to a command signal issued from the controller 80.

The controller 80 is a programmable logic control unit or other microprocessor device which maintains the load on the rider independent of centrifuge turntable RPM. Control is maintained by using feedback from a pedal crank torque (load) sensor 84 and pedal RPM sensor 86. The controller 80 compares the preset commanded values (centrifuge RPM and loading on the pedaling rider) to the actual values and adjusts the proper tension on the strap of the flywheel and selects the appropriate gear ratio on the automatic transmission. The adjustment of the loading on the strap of the flywheel is done by sensing and feeding back the strap tension to the controller 80 with a strap tension sensor signal to the linear actuator 82, and the gear change is done by the linear actuator 78. Turntable RPM is sensed by a sensor 90 and fed back to the controller 80.

Using the control apparatus described above, the rotation rate of the centrifuge, and thus the centrifugal force acting on the rider, can be preset and changed as desired prior to or during operation. The workload or power output required of the rider can be preset and maintained at a constant level independent of the centrifuge rotation rate.

For constant rotation rate operation, the centrifuge will rotate to the preset level and not turn any faster regardless of additional rider power input. This is accomplished through a feedback system using rotation rate or centrifugal force to cause excess power to be diverted to storage or converted to waste energy.

For constant rider power input the centrifuge can be set to rotate at a desired rotation rate equal to the maximum available at a given rider power output or any rotation rate requiring less power than is being provided by the rider.

Once a desired rider power or centrifuge rotation rate is preset, resistance is provided by a torque limiting device which can be either mechanical or electrical or a combination of the two. The two torque limiting system maintains constant power output to the centrifuge regardless of rider power input greater than is necessary to achieve the preset rotation rate of the centrifuge.

In operation, a console 92 is used by the operator to select the desired RPM and rider power settings. Power from the rider is then transmitted from the pedal crank through the chain 66 to a freewheel sprocket of the type used by bicycles, and then to the transmission 68. The transmission supplies power to the output shaft 74 which rotates the centrifuge through the centrifuge hub 76.

The controller 80 compares feedback signals from the torque and RPM sensors on the pedal mechanism, and from a centrifuge RPM or G sensor to the console settings, and adjusts the transmission gear ratio through the derailleur by signal to the linear actuator 78 to achieve correct centrifuge RPM. The controller issues control signals that adjust the tension on the flywheel strap through the linear actuator 82 to achieve the correct rider power load.

Figure 3:
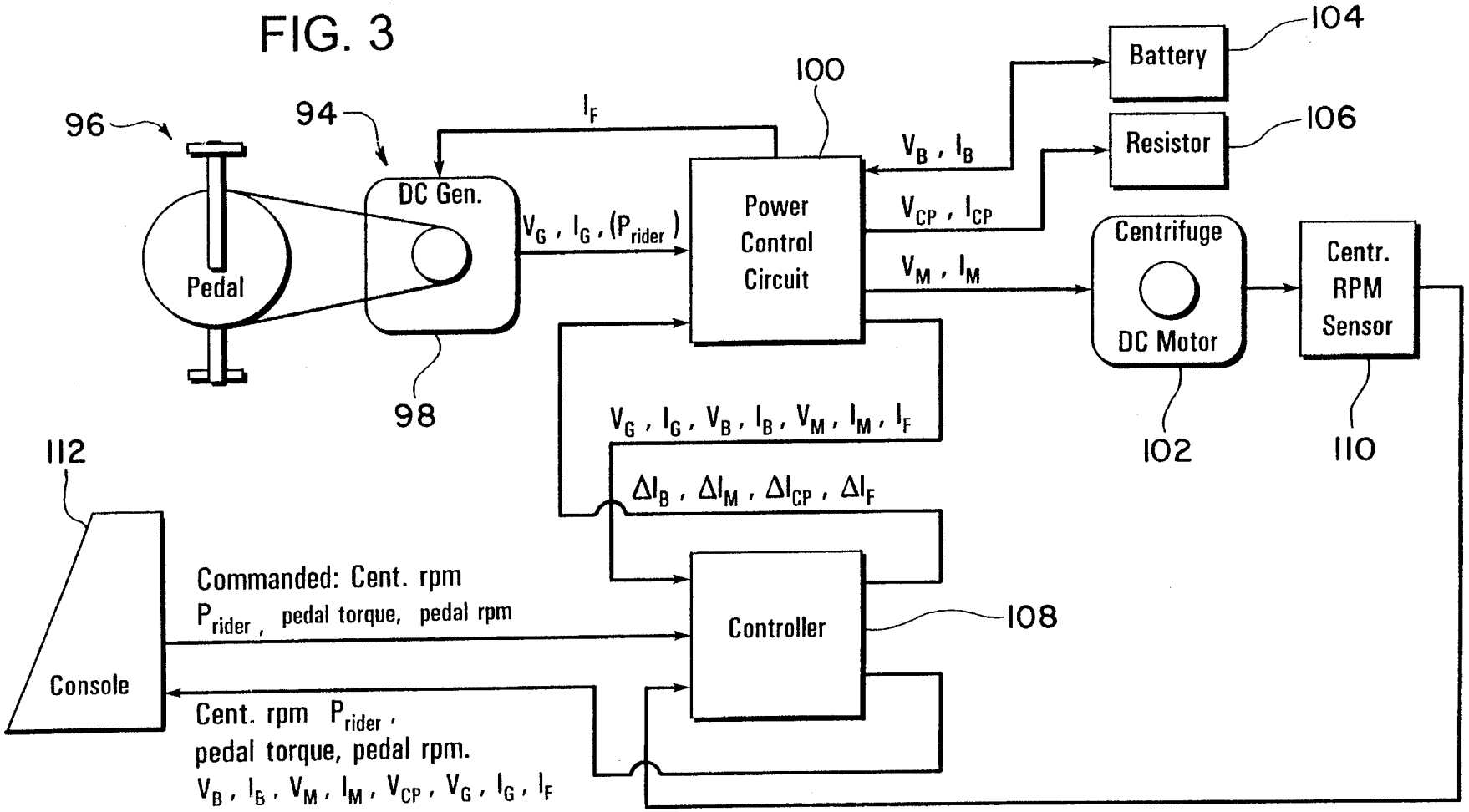
FIG. 3 is a schematic view of a human powered centrifuge according to another embodiment of the present invention.

Referring to FIG. 3, another embodiment of a human powered centrifuge 94 is adaptable for use in conjunction with the turntables of the previous embodiments. The centrifuge 94 includes at least one pedal mechanism 96 which drives a DC generator 98 which produces a DC generator output voltage $V_G$ and output current $I_G$ which are delivered to a power control circuit 100 where it is split into battery voltage and current, $V_B$ and $I_B$, respectively, DC motor input voltage and current, $V_M$ and $I_M$, respectively, and DC generator field current, $I_F$.

As shown schematically in FIG. 3, $V_B$, $I_B$, $V_M$, $I_M$, and $I_F$ are fed as input signals to a controller 108, which is preferably a microprocessor, and compared to reference values consisting of commands input at the console 112 and a turntable RPM sensor 110.

Rather than the pedal mechanism 96 mechanically driving the turntable, the DC motor 98 converts the mechanical energy delivered by the rider to electrical energy which powers a DC motor 102 coupled to the turntable. With this arrangement, pedal RPM and torque are independent of centrifuge RPM within limits of available power.

Excess power generated by the pedals and converted to electricity by the DC generator 98 can be delivered to a battery 104 as $V_B$ and $I_B$, or dissipated through a resistor 106, such as carbon pile, as $V_{CP}$ and $I_{CP}$.

Once the controller 108 compares the input values of voltage and current to those input at the console 112 and selected to achieve a desired turntable RPM and rider workload, it then distributes the energy between the battery 104, resistor 106, and the motor 102. $I_F$ acts as a feedback loop to maintain the DC generator voltage and current, $V_G$ and $I_G$, which in turn regulate the DC motor input voltage and current $V_M$ and $I_M$ which in turn control the centrifuge RPM.

The controller/microprocessor 108 receives input signals from a turntable RPM sensor 110 and determines rider workload, which is determined by the relationship $P_{rider}=\tau_{pedal}\times n_{pedal}$, where P is power, $\tau$ is torque and n is RPM. Pedal RPM, torque and input power are calculated from the field current, $I_F$, the DC generator output voltage, $V_G$, and the DC generator output current, $I_G$. $I_F$ is modulated by the controller 108 to maintain constant generator output voltage. $I_G$ can be modulated by the controller 108 to regulate pedal power or pedal torque. The centrifuge RPM (G level) is maintained by regulating the DC motor input voltage, $V_M$, and the DC motor input current, $I_M$.

The FIG. 3 embodiment is operable in at least two optional modes of operation. The first is a constant torque mode, in which the controller modulates $I_F$ in response to changes in pedal RpM to hold $V_G$ constant and simultaneously modulates the $I_G$ load to hold pedal torque constant.

The second is a constant power mode, in which the controller modulates $I_F$ in response to changes in pedal RPM to hold $V_G$ constant and simultaneously hold the $I_G$ load constant.

In either mode, the power control circuit 100 distributes the energy passed to the battery 104, the resistor 106 and the motor 102 to maintain the commanded turntable RPM. Commanded turntable RPM and rider input power (pedal torque and RPM) are selectively entered at the console 112. Thus, the mode of operation, as well as the levels of torque delivered by the pedal mechanism 96 and turntable RPM, and thus G force, can be selected, entered and monitored at the console 112.

In the FIG. 3 embodiment, the generator not only serves as a power conversion component, but also is calibrated to serve as an ergometer. The torque, RPM, and power load on the rider can be calculated from output voltage, output current, and field current.

The storage battery allows excess power from the rider to be saved for use during centrifuge acceleration (when a large amount of power is needed for a short period of time). This energy capacitance minimizes transient changes in the rider's work load during centrifuge RPM changes.

The microprocessor 108 could be programmed to provide any customized workout desired. Such a system would be very flexible and expandable. Possible expansions or alternate embodiments include bio-feedback, in an attempt to bring a subject to a commanded level of oxygen consumption, or heart rate.

The embodiments described herein can be used to create centrifugation for providing resistance and G forces, separately or in combination, for exercise, research, therapy, entertainment or any other uses. The turntable can as shown be sized to accommodate anywhere from 1 to 6 riders and can be propelled by one or more riders or by an off-board rider or other power source.

While specific pedal stations employing bicycle components have been described, other types of power input, gearing and drive trains can be employed. Rider power input can be, for example, by arm circular motion or by a combination of arm and leg motion, such as a rowing motion.

The present invention can be used on ground or in space to examine the efficacy of providing separate or combined G and exercise in a wide range of intensity to offset either known or unknown effects of long term exposure to micro or zero gravity.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A human powered centrifuge comprising:

a rotatable platform mounted for rotation about an axis at a predetermined angular velocity, and having means for supporting at least one rider thereon;

at least one human driven rotatable power source coupled to the rotatable platform, and having a power output which varies in accordance with angular velocity and torque; and control means for independently controlling the platform angular velocity and the power output of the power source.

2. A human powered centrifuge according to claim 1, wherein the at least one power source includes at least one on-board pedal mechanism operatively coupled to the turntable.

3. A human powered centrifuge according to claim 2, wherein the at least one on-board pedal mechanism includes a recumbent rider seat mounted on the turntable.

4. A human powered centrifuge according to claim 1, wherein the at least one power source includes an off-board pedal mechanism operatively coupled to the turntable.

5. A human powered centrifuge according to claim 1, wherein the control means includes means for inputting a desired platform angular velocity, means for monitoring actual platform angular velocity, and means for varying the power output of the at least one power source to maintain the desired platform angular velocity.

6. A human powered centrifuge according to claim 1, wherein the at least one power source includes a pedal mechanism and a drive train coupling the pedal mechanism to the platform.

7. A human powered centrifuge according to claim 6, wherein the drive train includes a power output device coupled to the platform, a mechanical transmission for varying the angular velocity of the power output device, and means for varying the torque applied to the power output device in accordance with a value input by the control means.

8. A human powered centrifuge according to claim 7, wherein the torque varying means is a flywheel friction brake, and an actuator operable in response to the control means.

9. A human powered centrifuge according to claim 8, further comprising means for detecting angular velocity and torque of the pedal mechanism and the control means includes feedback loop means for controlling the state of the transmission and the friction brake in accordance with the detected angular velocity and torque of the pedal mechanism.

10. A human powered centrifuge according to claim 1, wherein the at least one power source includes a pedal mechanism operatively coupled to an electric generator, an electric motor operatively coupled to the platform, and a control circuit for supplying the motor with a control amount of electric power generated by the generator.

11. A human powered centrifuge according to claim 10, wherein the control means includes a console having means for inputting the desired platform angular velocity and a desired generator power output, means for comparing generator output voltage and current, motor input voltage and current, and generator field current to predetermined values corresponding to the desired platform angular velocity and generator power output.

12. A human powered centrifuge according to claim 10, wherein the control means includes means for modulating a field current of the generator in response to changes in the angular velocity of the pedal mechanism the thereby hold constant an output voltage of the generator, and means for modulating the output generator current load to hold torque of the pedal mechanism constant.

13. A human powered centrifuge according to claim 10, wherein the control means includes means for modulating a field current of the generator in response to changes in angular velocity of the pedal mechanism to thereby hold constant the output voltage of the generator, and means for holding the generator output current constant.

14. A human powered centrifuge according to claim 10, further comprising a battery coupled to the control circuit and a resistor coupled to the control circuit, and the control means includes means for determining a distribution of power from the generator between the battery, the resistor, and the motor.

15. A human powered centrifuge according to claim 10, further comprising a platform angular velocity sensor and the control means includes a feedback loop for maintaining a predetermined power input to the motor corresponding to that which is necessary to maintain the desired platform angular velocity.

* * * * *